United States Patent [19]

Mohr

[11] 3,963,966

[45] June 15, 1976

[54] HAMMER FOR A PIEZOELECTRIC IGNITER

[75] Inventor: Walter Mohr, Frankfurt am Main, Germany

[73] Assignee: Braun Aktiengesellschaft, Frankfurt am Main, Germany

[22] Filed: May 14, 1974

[21] Appl. No.: 469,746

[30] Foreign Application Priority Data

May 14, 1973 Germany ..... 2324227
May 14, 1973 Germany ..... 2324229

[52] U.S. Cl. ..... 317/81; 310/8; 310/8.3; 317/DIG. 11; 310/8.7

[51] Int. Cl.[2] ..... F23Q 3/00; H01L 41/08

[58] Field of Search ..... 317/81, DIG. 11; 310/8.3, 8.7, 8; 431/130, 255

[56] References Cited

UNITED STATES PATENTS

| | | | |
|---|---|---|---|
| 3,364,451 | 1/1968 | Paul et al. | 338/47 |
| 3,366,808 | 1/1968 | Steward | 310/8.3 |
| 3,389,275 | 6/1968 | Brothers | 310/8.3 |
| 3,449,637 | 6/1969 | Suzuki | 317/81 |
| 3,457,461 | 7/1969 | Steinke et al. | 317/81 |
| 3,509,388 | 4/1970 | Mitune et al. | 310/8.7 |
| 3,540,823 | 11/1970 | Ebine et al. | 431/255 |
| 3,541,360 | 11/1970 | Tonari | 310/8.7 |
| 3,586,888 | 6/1971 | Dorfman | 310/8.3 |
| 3,729,639 | 4/1973 | Heinouchi et al. | 310/8.3 |
| 3,758,262 | 9/1973 | Harris | 431/130 |
| 3,793,561 | 2/1974 | Lundh | 317/81 |
| 3,898,534 | 8/1975 | Mohr | 317/81 |

*Primary Examiner*—A. Bartis
*Attorney, Agent, or Firm*—Frederick E. Bartholy

[57] ABSTRACT

A piezoelectric igniter includes a piezoelectric transducer positioned adjacent the closed bottom of a cylindrical housing. A hammer of magnetic material is axially movably guided in the housing toward impact with the transducer. An axially movable actuating member is provided in the top of the housing and the hammer is biased by a compression spring disposed between the actuator and the hammer. The hammer is attracted and held in its rest position by a permanent magnet structure located within the compression spring, and is released and accelerated towards the transducer when the compressive force of the spring, when compressed by the actuator, exceeds the attraction of the permanent magnet during operation of the igniter. A spring between the hammer and transducer returns the hammer to its rest position after impact with the transducer. The hammer may comprise an iron cup filled with lead.

7 Claims, 4 Drawing Figures

HAMMER FOR A PIEZOELECTRIC IGNITER

BACKGROUND OF THE INVENTION

The invention relates to a piezoelectric igniter with a striking mechanism, more especially for lighters, having a piezoelectric transducer, a hammer which is movable in the direction of the latter and which cooperates with a compression spring compressible by an actuating member, having a release device or trigger for the movement of the hammer, and having a housing which receives these parts and against the one front end of which the piezoelectric transducer butts.

In such piezoelectric igniters it is essential that the hammer be guided in a straight line and should not tilt in order to avoid substantial frictional forces during the movement of the hammer.

SUMMARY OF THE INVENTION

It is an object of the invention to provide a piezoelectric igniter which is simple and compact.

The solution to this problem is to be seen in that the hammer is guided at the inner wall of the housing and projects, over a part of its length, into the interior of the compression spring and that an axially operable magnetic holding device is used as release device or trigger for the movement of the hammer. By this means it is achieved that even with a comparatively short section of the part of the hammer that comes into contact with the inner wall of the housing, a good guidance of the same is achieved and that no tilting forces arise.

A particularly friction-resistant guidance is brought about when the hammer and the housing have a circular cross-section.

It is furthermore favourable to manufacture the housing from plastics material, in order to reduce particularly the friction factor between housing and hammer.

A maximum impact energy is achieved when the hammer is made at its impact surface of a deformation-proof material and a further part of the hammer is made of lead.

According to a preferred embodiment, the hammer contains at least one magnetically conductive part, which is a component part of a magnetic release or trigger device.

BRIEF DESCRIPTION OF THE DRAWINGS

The invention will be further described hereinafter in several exemplified embodiments with reference to diagrammatic drawings.

FIG. 5 is an axial section through a further embodiment of a piezoelectric igniter in which the hammer contains a permanent magnet.

DETAILED DESCRIPTION OF THE EMBODIMENTS

Figure 1:
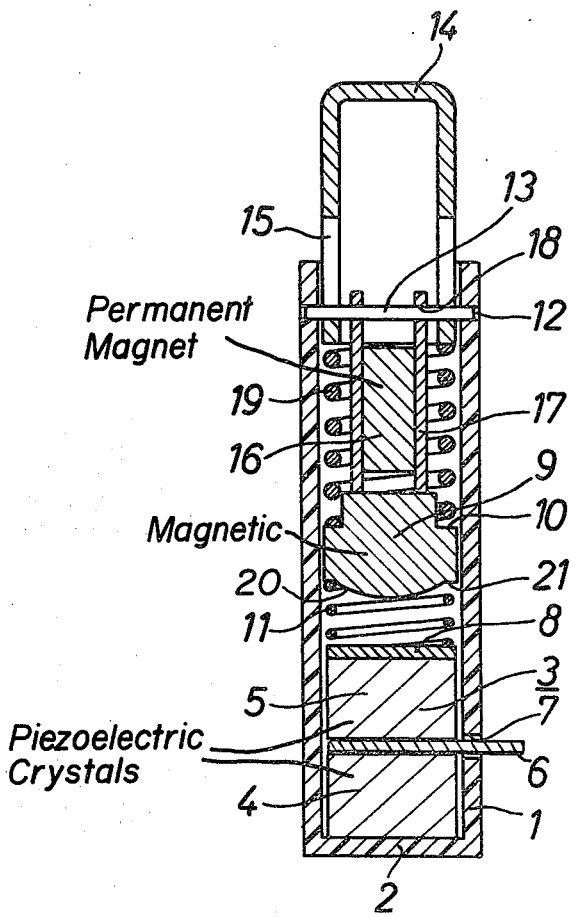
FIG. 1 is an axial section through a piezoelectric igniter according to the invention.

The piezoelectric igniter shown in FIG. 1 comprises a cylindrical housing 1 made of a plastics material. The housing is closed at one end by a bottom 2. Resting on the bottom 2 of the housing there is a piezoelectric transducer 3 which consists of two piezoelectric barium titanate crystals 4 and 5 arranged in series and between which an electrode 6 is inserted which extends towards the outside through an aperture 7 in the housing. A bounce plate 8 made of metal is situated on top of the piezoelectric barium titanate body 5. Said bounce plate may be bonded to the barium titanate body.

The piezoelectric igniter furthermore comprises a hammer 9 which is provided at its upper end with a circumferential recess which ends at a shoulder 10. Disposed between the bounce plate 8 and the underside 20 of the hammer 9 is a return spring 11 which has parallely ground end faces. To ensure a good abutment of the return spring 11 against the underside 20 of the hammer, the edge region 21 of the underside is made flat. The central region of the underside is convex.

At the open end of the housing 1 there are diametrically opposite bores 12, through which a holding pin 13 is driven, which serves for holding an actuating cap 14 and a permanent magnet arrangement.

The actuating cap 14 is cup-shaped and has two diametrically opposite longitudinal slots 15 which extend in axially parallel relationship and through which the holding pin 13 is placed. The slots 15 allow movement of the actuating cap 14 corresponding to their length.

The permanent magnet arrangement comprises a magnet 16, at the two opposite longitudinal side faces of which pole plates 17 are fitted which protrude on both sides somewhat beyond the length of the permanent magnet 16. The pole plates 17 are glued to the permanent magnet 16.

The upper ends of the pole plates 17 are provided with bores 18, through which the holding pin 13 extends and holds the permanent magnet arrangement, namely the parts 16 and 17, to the housing 1.

The lower ends of the pole plates 17 abut against the upper surface of the hammer 9, which consists of a ferromagnetic material and is therefore retained by the magnetic flux.

The compression spring 19 acts on the upper surface of the hammer 9, at one end, and on the lower edge of the actuating cap 14, at the other end.

The piezoelectric igniter has the following mode of operation. In the state of rest shown in FIG. 1, the compression spring 19 is in its relaxed state, so that it does not exert any substantial force on the hammer 9. If the actuating cap 14 is now pressed downwards, the spring 19 is compressed and, accordingly, an increasing force is exerted on the hammer 9. As soon as the compressive force of the spring 19 exceeds the retaining force of the permanent magnet arrangement, the hammer detaches itself from the same and is impelled downwards against the bounce plate 8, at the same time return spring 11 exerts a pressure on the piezoelectric crystals 4 and 5 before the hammer 9 strikes the bounce plate 8. The piezoelectric crystals are compressed by the action of the return spring to such an extent that they rest solidly against one another. Thus, the piezoelectric transformer generates a maximum electric energy.

The circumferential recess 10 of the hammer 9 allows a reception of the compression spring 19 in the compressed state of the same, that is to say shortly before the hammer 9 detaches itself from the permanent magnet arrangement. By this means a short construction of the piezoelectric igniter may be achieved.

Figure 2:
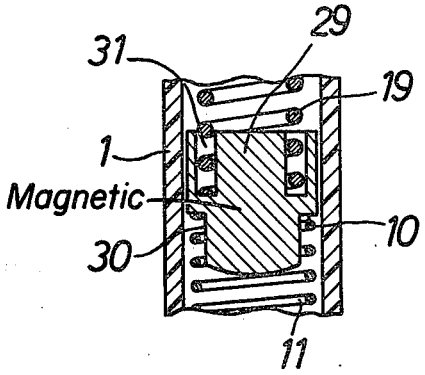
FIG. 2 is an axial section through the central region of a piezoelectric igniter which is modified in relation to FIG. 1.

FIG. 2 shows, in an axial section, a modified construction of the hammer shown in FIG. 1. The hammer 29 is arched at its side facing the bounce plate 8 and, a circumferential recess 30 is provided which ends at a shoulder 10, on which the return spring 11 abuts.

The upper surface of the hammer 29, facing the permanent magnet arrangement, is provided with an annular groove forming a cup 31 which houses the compression spring 19.

Figure 3:
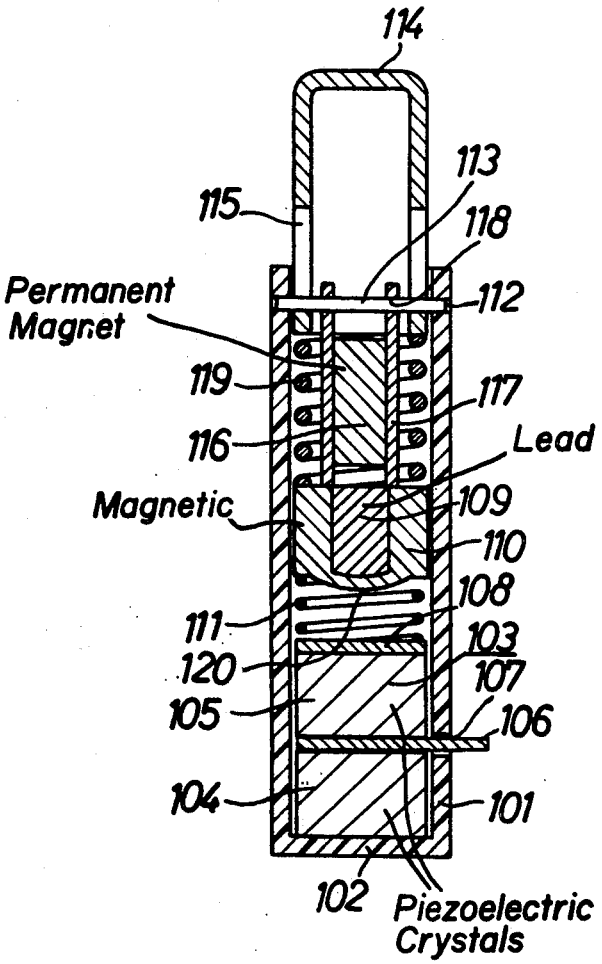
FIG. 3 is an axial section through a piezoelectric igniter according to the invention.

The igniter shown in FIG. 3 comprises a cylindrical housing 101 made of plastic material. The housing 101 has a circular cross-section and is closed at one end by a bottom 102 on which rests a piezoeletric transducer 103 consisting of two barium titanate crystals 104 and 105 between which an electrode 106 is inserted extending to the outside through an aperture 107. A bounce plate 108 made of metal is situated on top of the crystal 105.

The igniter includes a hammer which consists of a cup-shaped shell 110, in which a lead core 109 is enclosed. The shell is made of iron and is arched at its bottom side 120.

Diametrically opposite bores 112, through which a holding pin 113 is driven, are provided near the open end of the housing 101. The holding pin retains an actuating cap 114 and a permanent magnet arrangement.

The cap 114 is cup-shaped and has two diametrically opposite slots 115 which extend in axially parallel relationship and through which the holding pin 113 is placed. The slots 115 allow up and down movement of the cap 114. The latter has an external diameter somewhat smaller than the internal diameter of the housing 101 in order to prevent tilting.

The magnet arrangement comprises a permanent magnet 116, at opposite side faces of which plates 117 are placed. These project somewhat beyond the magnet 116 in the axial direction. The pole plates 117 are attached to the permanent magnet 116 by gluing.

The upper ends of the pole plates 117 are provided with bores 118 through which the holding pin 113 is placed.

The lower ends of the pole plates 117 abut against a front surface of the shell 110, which consists of ferromagnetic material and is therefore retained by the magnetic flux.

The igniter further comprises a compression spring 119 which acts at one end on the upper front surface of the shell 110, at the other end, and on the front edge of the open end of the actuating cap 114.

The igniter has the following mode of operation. In the state of rest, shown in FIG. 3, the compression spring 119 is in relaxed state, so that it does not exert any substantial force on the hammer 110. If the actuating cap 114 is pressed down, the spring 119 is compressed so that an increasing force is exerted on the hammer, 110. As soon as the compressive force of the spring 119 exceeds the retaining force of the permanent magnet arrangement, the hammer detaches itself and is impelled against the bounce plate 108. The return spring 111 exerts a pressure on the piezoelectric transducer before the hammer, 110 impinges on the bounce plate 108. In any case, the individual parts of the piezoelectric transducer are compressed by the action of the return spring to such an extent that they contiguously rest against one another. By the compression of the piezoelectric transducer before the impact of the hammer a maximum energy conversion transducer is achieved.

The return spring 111 may be dimensioned such that in the state of rest a compressive force is exerted on the transducer 103. Alternatively, the return spring may be designed so that it does not exert a compressive force until the hammer moves towards the bounce plate 108.

The high mass of the hammer has the effect that the kinetic energy achieved during the downward movement against the bounce plate 108 exerts a force on the piezoelectric transducer 103 over a longer period in comparison to a lighter hammer, which would be accelerated to a higher speed.

Figure 4:
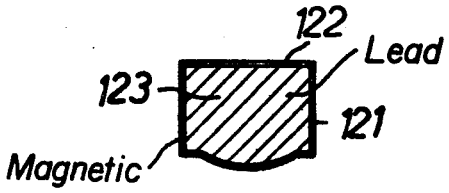
FIG. 4 is an axial section through another embodiment of a hammer.

FIG. 4 shows a modified embodiment of a hammer for use in the igniter according to FIG. 3. This hammer consists of a deep-drawn sheet iron cup 121, the upper edge 122 of which is beaded towards the inside in flange-like manner. The interior is filled with a lead core 123.

The term transducer is intended to designate any kind of a piezoelectric device for connecting mechanical impact into electrical energy.

I claim:

1. A piezoelectric igniter for lighters, including a cylindrical housing having a closed bottom, a piezoelectric transducer positioned adjacent the bottom of said housing, a hammer of magnetic material axially movably guided in said housing towards impact with said piezoelectric transducer, an actuating member at the top of said housing and axially movable with respect to said housing, a compression spring disposed between said actuating member on the one hand and said hammer on the other hand, and a magnetic retentive means comprising a magnet having pole plates fixed to opposite sides thereof, said magnetic retentive means being fixedly supported by said housing between said actuating member and said hammer, said magnetic retentive means being magnetically coupled to said hammer to retain said hammer in a rest position, said compression spring surrounding said magnetic retentive means, and a retraction means for returning said hammer to said rest position after impact with said piezoelectric transducer.

2. A piezoelectric igniter in accordance with claim 1, wherein said hammer projects over a part of its length into the interior of said compression spring.

3. A piezoelectric igniter in accordance with claim 1, wherein said hammer includes at its upper end, a shoulder on which abuts the end of said compression spring.

4. A piezoelectric igniter in accordance with claim 2, wherein said hammer includes in the upper surface thereof an annular groove into which said compression spring extends.

5. A piezoelectric igniter in accordance with claim 1, wherein said hammer comprises a cup shaped shell which is at least partially filled with lead.

6. A piezoelectric igniter in accordance with claim 1, wherein said hammer comprises a sheet iron cup filled with a lead core.

7. A piezoelectric igniter in accordance with claim 1, wherein said magnetic retentive means is fixed relative to said housing by means of a transverse pin passing through said pole plates and wherein said actuating member is cup-shaped and has two opposite longitudinal slots through which said pin extends.

* * * * *